United States Patent [19]

Rady

[11] 3,934,806

[45] Jan. 27, 1976

[54] BI-LEVEL BOOK STAND

[76] Inventor: David M. Rady, 4742 Rolando, San Diego, Calif. 92115

[22] Filed: Oct. 9, 1974

[21] Appl. No.: 513,274

[52] U.S. Cl. ..... 248/441; 248/460; 248/163; 248/188.1

[51] Int. Cl.[2] ..... A47B 97/04

[58] Field of Search ..... 248/441–443, 248/445–457, 460, 461, 463, 464, 158, 163, 371, 188.1, 188.7, 188.8, 165; 108/1, 2, 6, 8–10

[56] References Cited

UNITED STATES PATENTS

| | | | |
|---|---|---|---|
| 772,473 | 10/1904 | Olcott | 248/441 |
| 1,660,169 | 2/1928 | Knell | 248/441 |
| 1,994,225 | 3/1935 | Lurcott | 248/449 |
| 2,236,133 | 3/1941 | Croninger et al. | 248/449 X |
| 2,465,206 | 3/1949 | Davis | 248/457 X |

FOREIGN PATENTS OR APPLICATIONS

| | | | |
|---|---|---|---|
| 621,028 | 3/1962 | Belgium | 248/441 |
| 536,691 | 4/1955 | Belgium | 248/449 |

*Primary Examiner*—Roy D. Frazier
*Assistant Examiner*—Terrell P. Lewis

[57] ABSTRACT

The invention is a book stand intended for use primarily in supporting shop manuals and other automotive books for an automobile mechanic, and comprises a tripod base with a vertical shaft and a book support tray that is removably mountable either atop the shaft or in the base at near floor level so that it is easily seen by the mechanic when standing or when working beneath the body of an automobile.

4 Claims, 3 Drawing Figures

BI-LEVEL BOOK STAND

BACKGROUND OF THE INVENTION

A mechanic servicing or repairing an automobile often utilizes a shop manual or other technical books while working and must refer to the book repeatedly at the various stages of the repair process. While working on the engine, for example, from above, it is possible to support the manual on a fender or a workbench, which is not always an ideal arrangement, but when working beneath the car he is generally on his back, and to refer to a manual laid on the floor from this position, often with his hands occupied, is extremely awkward if not impossible. The mechanic is thus in need of a mobile book stand which will support a shop manual or the like on an incline alternatively at about shoulder level when he works on the car from above, and at, or slightly above, floor level when he is working beneath the car.

SUMMARY OF THE INVENTION

The present invention fulfills the above mentioned need and comprises a versatile book stand having a tripod base with two wheels and a leg with a tubular horizontal portion, and a hollow vertical shaft mounted centrally on the base. A book support tray with two opposed parallel flanges the edges has a post extending at an angle from the rear surface thereof which is insertable in the top of the shaft to provide a chest level stand and alternatively insertable in the horizontal tube on the base at ground level, the tray being disposed at an angle of about 45° in either capacity.

DETAILED DESCRIPTION OF THE PREFERRED EMBODIMENT

Figure 1:
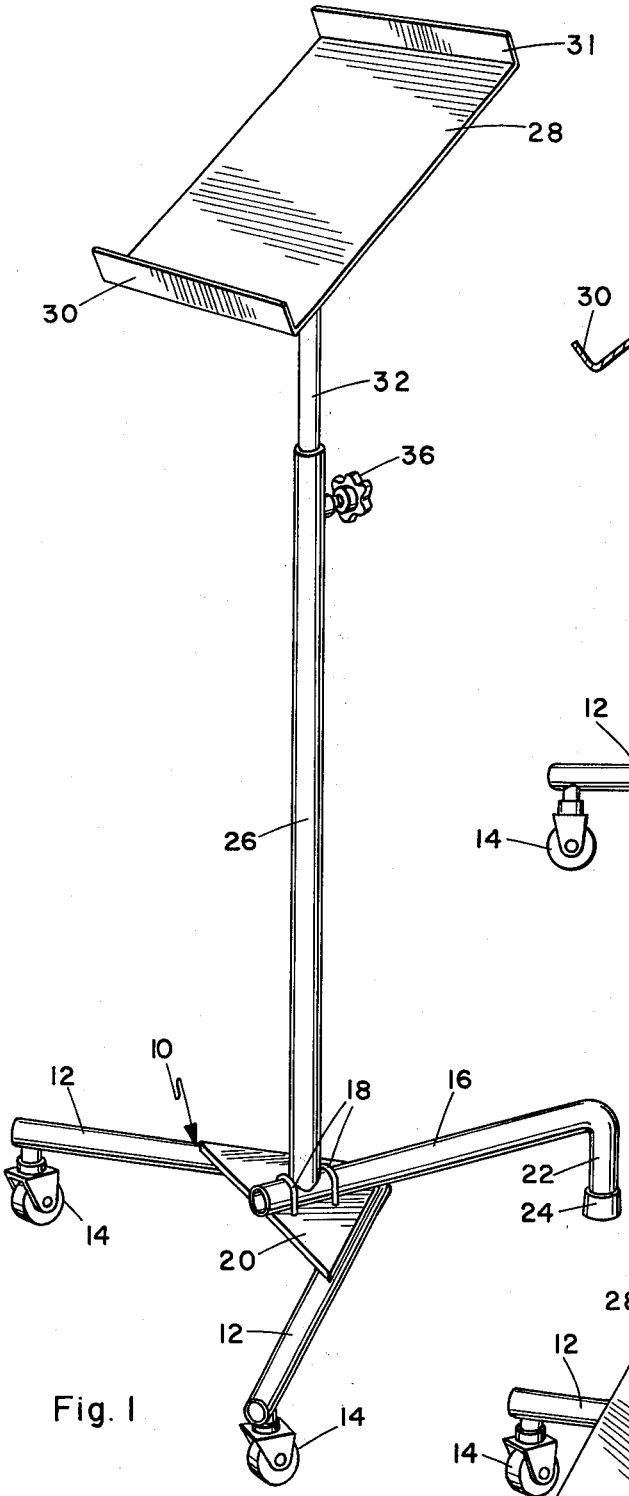
FIG. 1 is a perspective view of the book stand set for upright use.
Figure 2:
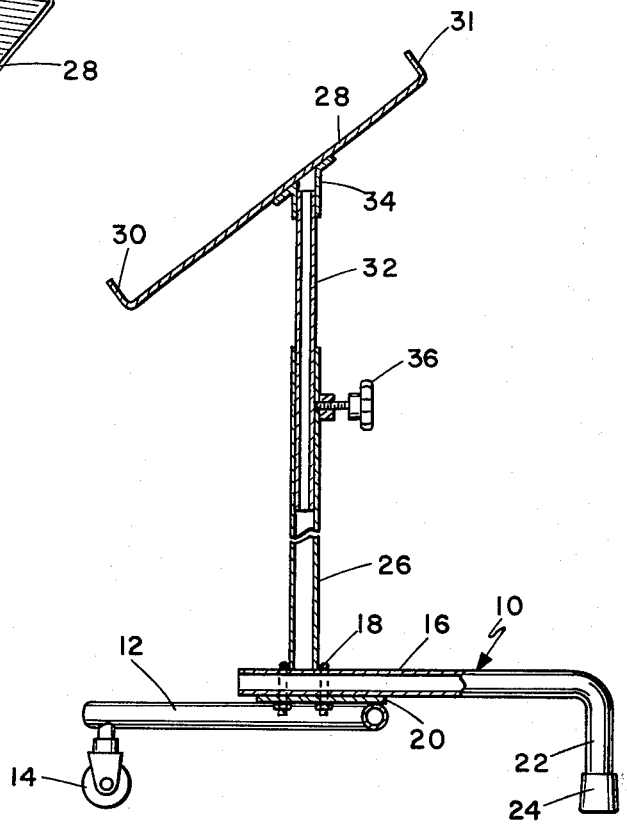
FIG. 2 is a side elevation view, partially in section.
Figure 3:
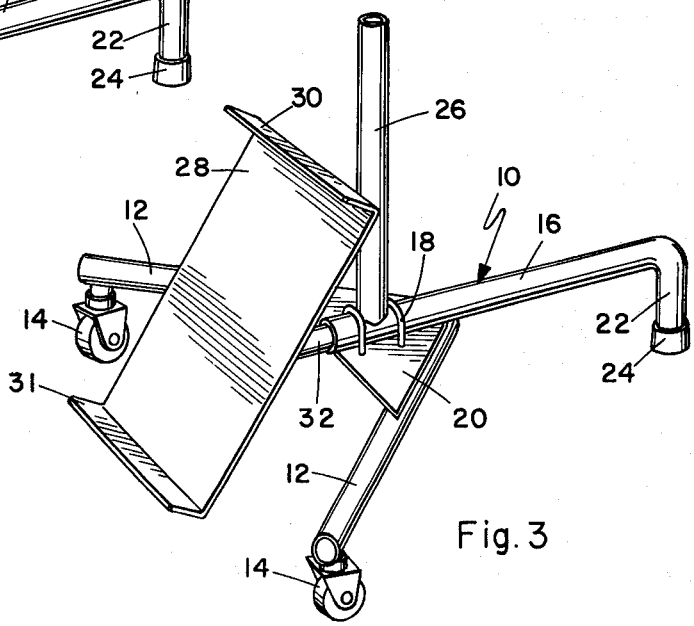
FIG. 3 is a perspective view with the book holder in the lower position.

The book stand includes a tripod base 10 comprising a pair of legs 12 which are preferably the two ends of a length of metal tubing having a central bend therein, with a pair of casters 14 mounted to the ends. A third leg 16 of the base, also constructed of hollow tubing to define a mounting socket at its mounted end, is mounted by U-bolts 18 to a plate 20 which is welded or otherwise attached to the vertex junction of the two legs 12. The distal end of leg 16 is downbent to from a foot 22 having a rubber cup 24 thereon to secure the stand against rolling when in use, rolling mobility obviously being achievable by tilting the stand onto the caster alone. A hollow vertical shaft is centrally mounted to the base by welding or other means such that the hollow interior of the leg 16 is not blocked or obscured.

The book-holding portion of the unit comprises a planar tray 28 which preferably has two parallel upbent flanges 30 and 31 extending orthogonally from opposite edges of the forward surface, and a post 32 is mounted to the rear surface of the tray at an angle by any suitable means such as by welding, in the drawing a flanged socket 34 being used to provide additional support to the post. The orientation of the post to the tray is preferably such that it is perpendicular to both of the flanges 30 and describes an angle of about 45° with a line in the plane of the tray and perpendicular to both of the tray edges to which the flanges are joined.

The tubular members 16 and 26 are both of a diameter sufficient to receive the post 32, so that as illustrated the tray may be mounted either in the open upper end of the shaft 26 in which case the flange 31 is uppermost, or re-oriented somewhat and the post inserted into the mounting socket defined by the hollow leg 16. A knob-operated set screw 36 is provided near the top of the shaft so that the tray is vertically adjustable, and when in the lower position the tray rests on the floor and may be extended horizontally to an extent limited only by the length of the post and the leg 16. It will be noted that in either position the tray will assume an angle of about 45° to the horizontal when the lower flange is horizontal due to the angle of attachment of the post to the tray.

Variations of the illustrated embodiment are possible within the scope of the invention. For example, the attachment of the post 32 to the tray could easily be made angularly adjustable to permit the establishment of tray angles other than 45°, or the tray could be centrally bent along a line parallel to the flanges to establish a different incline of the book-supporting surface of the tray for the upper and lower positions.

The book stand as described herein is prefectly adapted for use in automobile servicing, though of course its use is not limited to such. Two different book-supporting levels are established, the upper level being adjustable vertically and about the vertical axis and the entire unit being easily moved from one area to another on the two casters as different portions of an automobile are being service, the third leg providing stability against rolling when the stand is stationary.

I claim:

1. A book stand comprising:

a frame having a base and a shaft mounted to said base such that said shaft extends vertically upwardly from said base when the latter is disposed on a horizontal surface, the upper portion of said shaft defining an elongated vertical channel therein;

a tray having an inclined post mounted to the rear thereof and dimensioned to snugly seat in said channel whereby said tray is removably mountable substantially above said shaft and at an angle thereto; and said base including a mounting socket for snugly and removably receiving said post, whereby said tray is alternatively mountable on said shaft and in said socket.

2. Structure according to claim 1 wherein said base includes three horizontally extended legs each having a floor-contacting member depending therefrom, the portion of one of said legs opposite from said floor-contacting member defining said mounting socket.

3. Structure according to claim 2 wherein the floor-contacting portion of one of said legs defining a mounting socket, comprises a stabilizing foot, and the remaining two floor-contacting members comprise casters, whereby said book stand can be tilted to elevate said foot and rolled on said two casters.

4. Structure according to claim 1 wherein said tray has two substantially parallel edges and including two flanges, each being integral with one of said edges and orthogonally extending from said tray, and said post is perpendicular to both of said edges and define an angle of on the order of 45° with a line intersecting and perpendicular to both of said edges, one of said flanges serving as a book-supporting ledge when said panel is mounted on said upper portion of said frame and the other of said flanges serving as a book-supporting ledge when said panel is mounted on the lower portion of said frame, said base socket and tray being dimensioned such that the other of said flanges resting on the floor when said tray is mounted in said socket.

* * * * *